US006805588B2

(12) United States Patent
Yamamoto

(10) Patent No.: US 6,805,588 B2
(45) Date of Patent: Oct. 19, 2004

(54) CABLE CONNECTOR

(75) Inventor: Takashi Yamamoto, Hirakata (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 10/181,555

(22) PCT Filed: Jan. 29, 2001

(86) PCT No.: PCT/JP01/00588

§ 371 (c)(1),
(2), (4) Date: Jul. 19, 2002

(87) PCT Pub. No.: WO01/57965

PCT Pub. Date: Aug. 9, 2001

(65) Prior Publication Data

US 2003/0003805 A1 Jan. 2, 2003

(30) Foreign Application Priority Data

Feb. 3, 2000 (JP) ..... 2000-025789

(51) Int. Cl.[7] ..... H01R 13/648
(52) U.S. Cl. ..... 439/610; 439/610
(58) Field of Search ..... 439/607, 610, 439/608, 609, 98, 99

(56) References Cited

U.S. PATENT DOCUMENTS

| | | | | |
|---|---|---|---|---|
| 4,290,663 A | * | 9/1981 | Fowler et al. | 339/143 |
| 5,267,878 A | * | 12/1993 | Shinji et al. | 439/610 |
| 5,833,495 A | | 11/1998 | Ito | 439/610 |
| 5,906,513 A | | 5/1999 | Peterson et al. | 439/607 |

FOREIGN PATENT DOCUMENTS

| | | |
|---|---|---|
| EP | 0 971 442 A1 | 1/2000 |
| JP | 63-14377 | 1/1988 |
| JP | 61-86671 | 6/1988 |
| JP | 63-127074 | 8/1988 |
| JP | 1-155282 | 10/1989 |
| JP | 3-88577 | 9/1991 |
| JP | 3-126374 | 12/1991 |
| JP | 5-53162 | 7/1993 |
| JP | 6-88077 | 12/1994 |
| JP | 07336324 A | 12/1995 |
| JP | 8-22867 | 1/1996 |
| JP | 8-25018 | 9/1996 |
| WO | WO 01/57965 A1 | 6/2001 |

* cited by examiner

*Primary Examiner*—Alex Gilman
(74) *Attorney, Agent, or Firm*—Parkhurst & Wendel, L.L.P.

(57) ABSTRACT

The present invention is devised to provide an XSR cable connector with satisfactory extraneous emission performance. An outer conductor (2) of a cable (1) extends from the inside to the outside of a chuck (9) through the space between an outer jacket (4) of the cable and the rear end portion **(9*c*) of the chuck (9) so as to be interposed between the outer peripheral surface of the chuck (9) and the inner peripheral surface of a housing (8). Hence, the outer conductor (2) of the cable is in contact with the inner peripheral surface of the housing (8)** not at a point but on a surface for conduction, allowing the housing to be at the same potential as that of the outer conductor in terms of high frequency waves, remarkably improving extraneous emission of high frequency harmonics nose from the side of the housing as compared with the prior art.

6 Claims, 7 Drawing Sheets

CABLE CONNECTOR

TECHNICAL FIELD

The present invention relates to an XSR cable connector generally used in the field of audio products for professional use.

BACKGROUND ART

A typical XSR cable connector is configured as shown in FIGS. 6 and 7. Here, a male XSR cable connector will be described as an example.

A cable 1 is a twist pair cable formed of wires 3L, 3R and an outer conductor 2 that shields the same wires, and the outside of the outer conductor 2 is protected by an outer jacket 4. The XSR cable connector is assembled as follows: the wires 3L and 3R are soldered to male contacts 6*a* and 6*b* of an insert 5, the outer conductor 2 is soldered to a male contact 6*c* of the insert 5 and a leaf spring terminal 6*d*, and the insert 5 is inserted from the rear of a housing 8 made of conductive metal.

At this point, a chuck 9 made of insulating resin covers the rear of the insert 5. A slit 9*a* is formed on the side of the chuck 9, and a tapered part 9*b* is formed on the rear end.

Further, an internal thread 10*a* of a bushing 10, which is inserted to the rear of the chuck 9 and is made of insulating resin, is screwed onto an external thread 8*a* of the housing 8.

Hence, a leading end of the chuck 9 is brought into contact with the insert 5, the tapered part 9*b* on the rear end of the chuck 9 is pressed by an inner peripheral surface 10*b* of the bushing 10 as shown in FIG. 7, and a rear end portion 9*c* of the chuck 9 catches and holds the outer jacket 4 of the cable 1.

In the above conventional configuration, as shown in the state of assembling in FIG. 7, the housing 8 is connected to the outer conductor 2 of the cable 1 via the leaf spring terminal 6*d*, which is in contact with a part of the inner periphery of the housing 8, and the rear of the insert 5 is surrounded by the rear of the housing 8 which is connected to the outer conductor 2 of the cable 1 via the leaf spring terminal 6*d*.

However, since a handled signal has increased in frequency as audio video systems have recently improved in quality, improvement in high frequency characteristics has been demanded for XSR cable connectors under the present circumstances.

As a specific example, the following example will be discussed: a baseband signal receives a digital signal of 6 MHz (6 Mbps) via an XSR cable connector.

Considering the state of assembling in FIG. 7 at the above handled frequency, the housing 8 at the rear of the insert 5 has insufficient shielding effect, and an undesired signal S1 may be leaked from this part to the outside.

Moreover, when frequency components of the undesired signal S1 are examined, it is found that the leakage of high frequency harmonics nose is noticeable. This is because a contact point P1 with the leaf spring terminal 6*d* is only one secure contact point of the housing 8, a rear A of the housing 8 in terms of high frequency harmonics nose is equivalent to an antenna grounded at the contact point P1, and the undesired signal S1 is also emitted from the side of the housing 8.

DISCLOSURE OF INVENTION

The present invention is devised to solve the above described problem and has as its object the provision of an XSR cable connector which can handle a baseband signal having a higher band with satisfactory high frequency characteristics.

An XSR cable connector according to claim 1, in which an outer periphery of an insert having a contact is covered with a conductive housing, a chuck having the leading end being in contact with the insert is inserted into the housing at the rear of the insert, the rear end of the chuck is pressed in the inner periphery of a bushing mounted on the rear end of the housing, and a cable is caught and held at the rear end of the chuck, is characterized in that an outer conductor of the cable or a conductor connected to the outer conductor extends from the inside to the outside of the chuck through the space between an outer jacket of the cable and the rear end portion of the chuck so as to be interposed between the outer peripheral surface of the chuck and the inner peripheral surface of the housing and the conductor is brought into contact with the housing.

An XSR cable connector according to claim 2 of the present invention, in claim 1, is characterized in that a conductive tape is wound around the outer peripheral surface of the chuck via the outer conductor of the cable or the conductor connected to the outer conductor which extends from the inside to the outside of the chuck and is folded on the outer periphery of the chuck, and the conductive tape is brought into contact with the inner peripheral surface of the housing.

An XSR cable connector according to claim 3 of the present invention, in claim 1 or 2, is characterized in that the conductor connected to the outer conductor of the cable is a cylindrical braided wire.

An XSR cable connector according to claim 4 of the present invention, in claim 1 or 2, is characterized in that the cable has an outer conductor composed of a double braided wire, and the outer braided wire of the outer conductor extends from the inside to the outside of the chuck and is folded on the outer periphery of the chuck.

An XSR cable connector according to claim 5 of the present invention is characterized in that at least a part of the chuck is made of a conductive material, the outer conductor of the cable or the conductor connected to the outer conductor is interposed between the outer jacket of the cable and the rear end of the chuck so as to bring the chuck and the outer conductor of the cable into conduction, and the outer conductor of the cable is brought into contact with the inner peripheral surface of the housing via the chuck.

An XSR cable connector according to claim 6 of the present invention is characterized in that at least a part of the chuck is made of a conductive material, the outer conductor of the cable or the conductor connected to the outer conductor is interposed between the outer jacket of the cable and the rear end of the chuck so as to bring the chuck and the outer conductor of the cable into conduction, and the outer conductor of the cable is brought into contact with the inner peripheral surface of the housing via a conductive tape wound around the outer periphery of the chuck.

BEST MODE FOR CARRYING OUT THE INVENTION

Hereinafter, embodiments of the present invention will be discussed in accordance with FIGS. 1 to 5.

Figure 6:
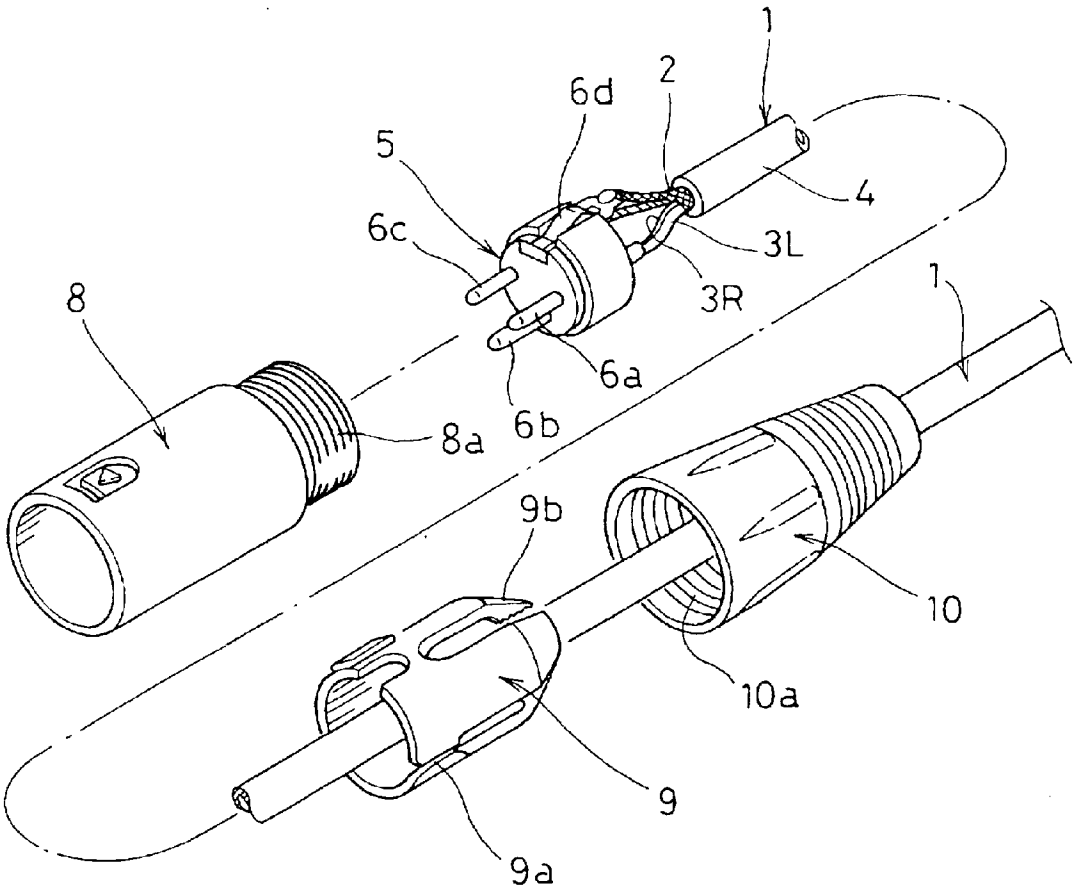
FIG. 6 PRIOR ART
FIG. 6 is an exploded perspective view showing a conventional male XSR cable connector.
Figure 7:
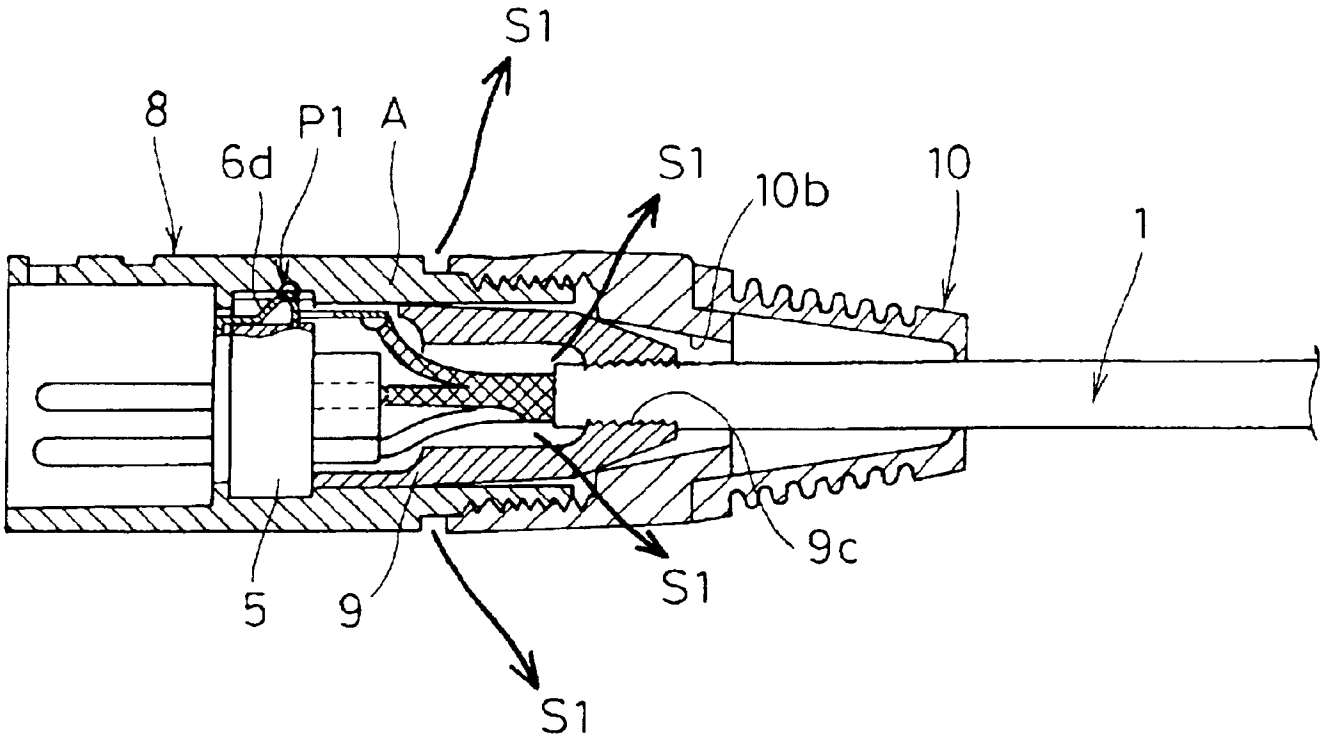
FIG. 7 PRIOR ART
FIG. 7 is a sectional view showing a state of assembling the prior art.

Here, the members having the same functions as those of FIGS. 6 and 7, which illustrate the prior art, will be indicated by the same reference numerals in the following explanation.

Embodiment 1

Figure 1:
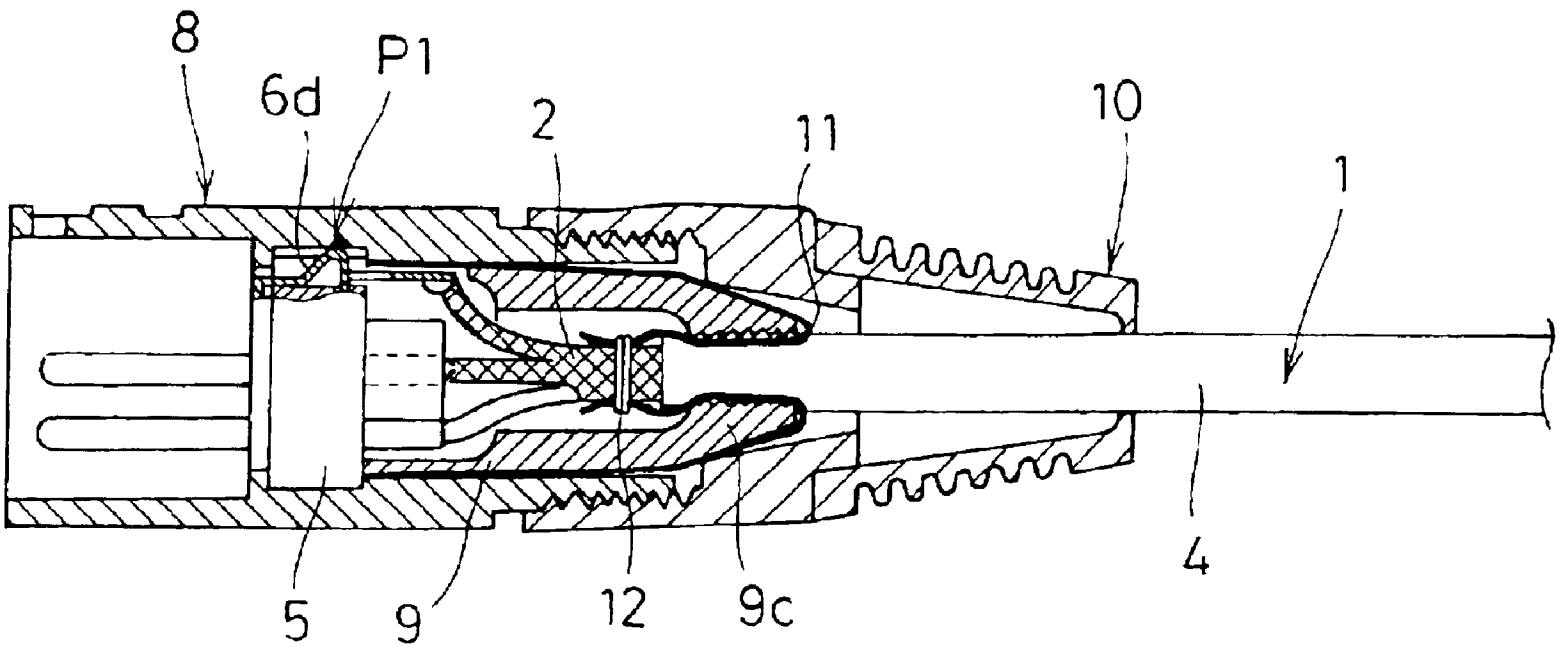
FIG. 1 is a sectional view showing a state of assembling a male XSR cable connector according to Embodiment 1 of the present invention.
Figure 2:
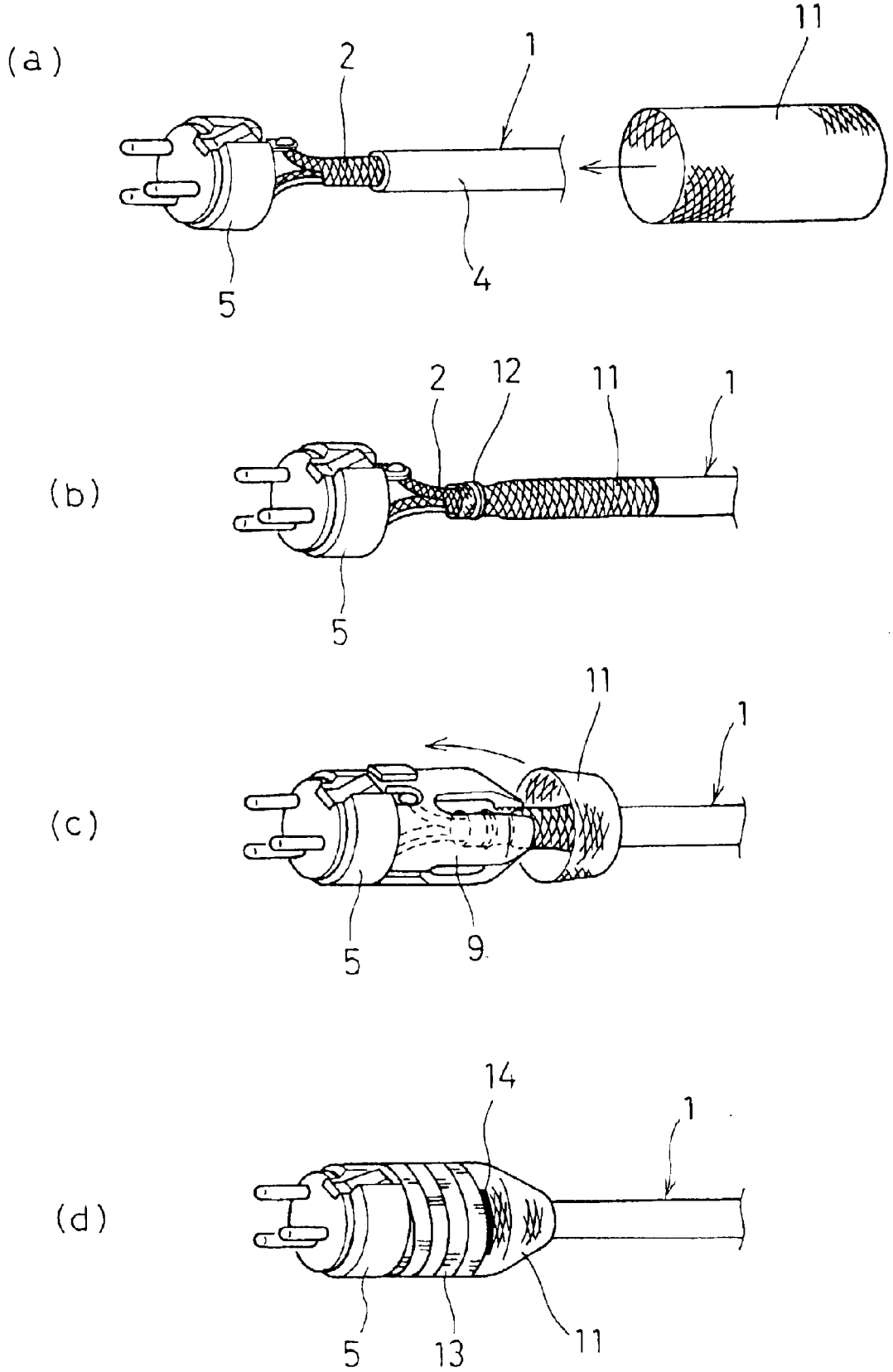
FIG. 2 is a perspective view showing an assembling process of Embodiment 1.

FIGS. 1 and 2 illustrate Embodiment 1 of the present invention.

In Embodiment 1, as in the prior art, a cable having an outer conductor composed of a single braided wire is used as a cable 1.

First, explanation will be made in accordance with FIGS. 1, 2(*a*), 2(*b*), and 2(*c*).

As shown in FIG. 2(*a*), in the assembling process, after the cable 1 is soldered to an insert 5 as in the prior art, a braided wire 11 being separate from the cable 1 is placed over the cable 1.

And then, as shown in FIG. 2(*b*), an end of the braided wire 11 is soldered to an outer conductor 2 of the cable 1. At this point, soldering is carried out after tying is performed by using a tinned wire 12 and so on.

And then, as shown in FIG. 2(*c*), a chuck 9 is mounted on the rear of the insert 5, and as shown in FIG. 1, the braided wire 11 passes through the space between an outer jacket 4 of the cable 1 and a rear end portion 9*c* of the chuck 9 and is drawn from the inside to the outside of the chuck 9.

As shown in FIG. 1, the drawn braided wire 11 is folded on the outer peripheral surface of the chuck 9, the folded braided wire 11 is inserted into a housing 8 together with the insert 5 so as to be interposed between the outer peripheral surface of the chuck 9 and the inner peripheral surface of the housing 8, and a bushing 10 is screwed onto the housing 8, so that the assembling is completed. Here, an interval is small between the housing 8 and the chuck 9. Thus, when the braided wire 11 is disposed in the interval therebetween, the interposed braided wire 11 is disposed between the outer peripheral surface of the chuck 9 and the inner peripheral surface of the housing 8 and the braided wire 11 is pressed over the inner peripheral surface of the housing 8. With this configuration, conduction is produced on the inner peripheral surface of the housing 8 via the braided wire 11 so as to surround the insert 5. Hence, the rear of the insert 5 is shielded more surely than the prior art by the braided wire 11 soldered to an outer conductor 2 of the cable 1.

Here, as to a reduction in extraneous emission of high frequency harmonics nose, an important point is that the outer conductor 2 of the cable 1 is connected to the housing 8 not only at a contact point P1 with a leaf spring terminal 6*d* but also is in contact with the inner peripheral surface of the housing 8 via the braided wire 11 so as to be brought into conduction. Thus, it is possible to allow the housing 8 to be at the same potential as that of the outer conductor 2 in terms of high frequency waves, thereby remarkably improving extraneous emission of high frequency harmonics nose from the side of the housing 8 as compared with the prior art.

Further, in order to obtain workability when the insert 5 is inserted into the housing 8 and to further reduce extraneous emission, when the insert 5 is inserted into the housing 8, as shown in FIG. 2(*d*), a conductive tape 13 having an adhesive layer on one surface is wound around the braided wire 11, which is folded on the outer peripheral surface of the chuck 9, while a conducting surface is disposed outside. The conducting surface on an end of the wound conductive tape 13 and the braided wire 11 are brought into conduction via solder 14 and so on, and the insert 5 is inserted into the housing 8 in a state in which the braided wire 11 is temporarily fixed so as not to be rolled up when the insert 5 is inserted into the housing 8.

In this case, the outer conductor 2 of the cable 1 is brought into conduction on the inner peripheral surface of the housing 8 via the braided wire 11 and the conductive tape 13, thereby obtaining the same high frequency performance.

In the example of the conductive tape 13 of the above embodiment, the conducting surface of the conductive tape and the braided wire 11 are in contact with each other via the adhesive layer of the conductive tape 13, so that conduction is not performed. Hence, the conducting surface on the end of the wound conductive tape 13 and the braided wire 11 are brought into conduction via the solder 14 and so on. Here, when a conductive tape is used which has conductive particles mixed in an adhesive layer, it is possible to eliminate the necessity for the solder 14 and it can be expected that the high frequency performance will further improve.

Embodiment 2

Figure 3:
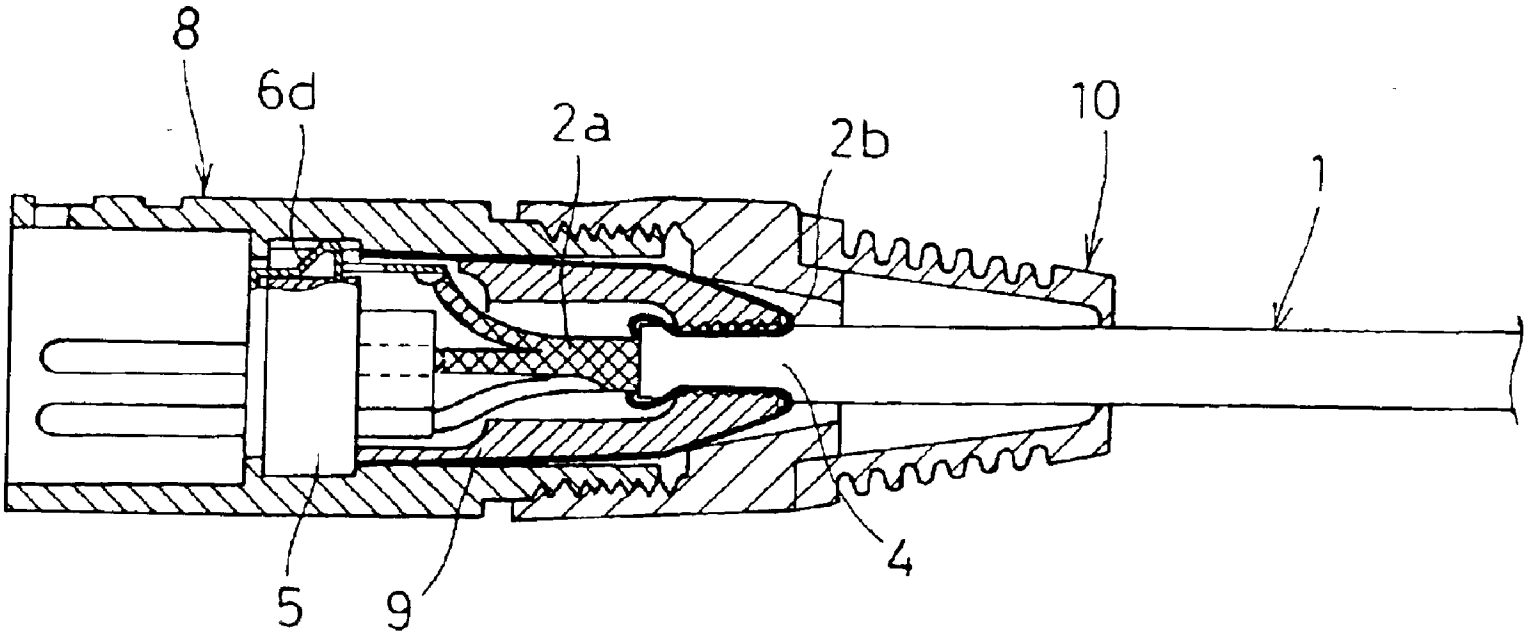
FIG. 3 is a sectional view showing a state of assembling a male XSR cable connector according to Embodiment 2 of the present invention.
Figure 4:
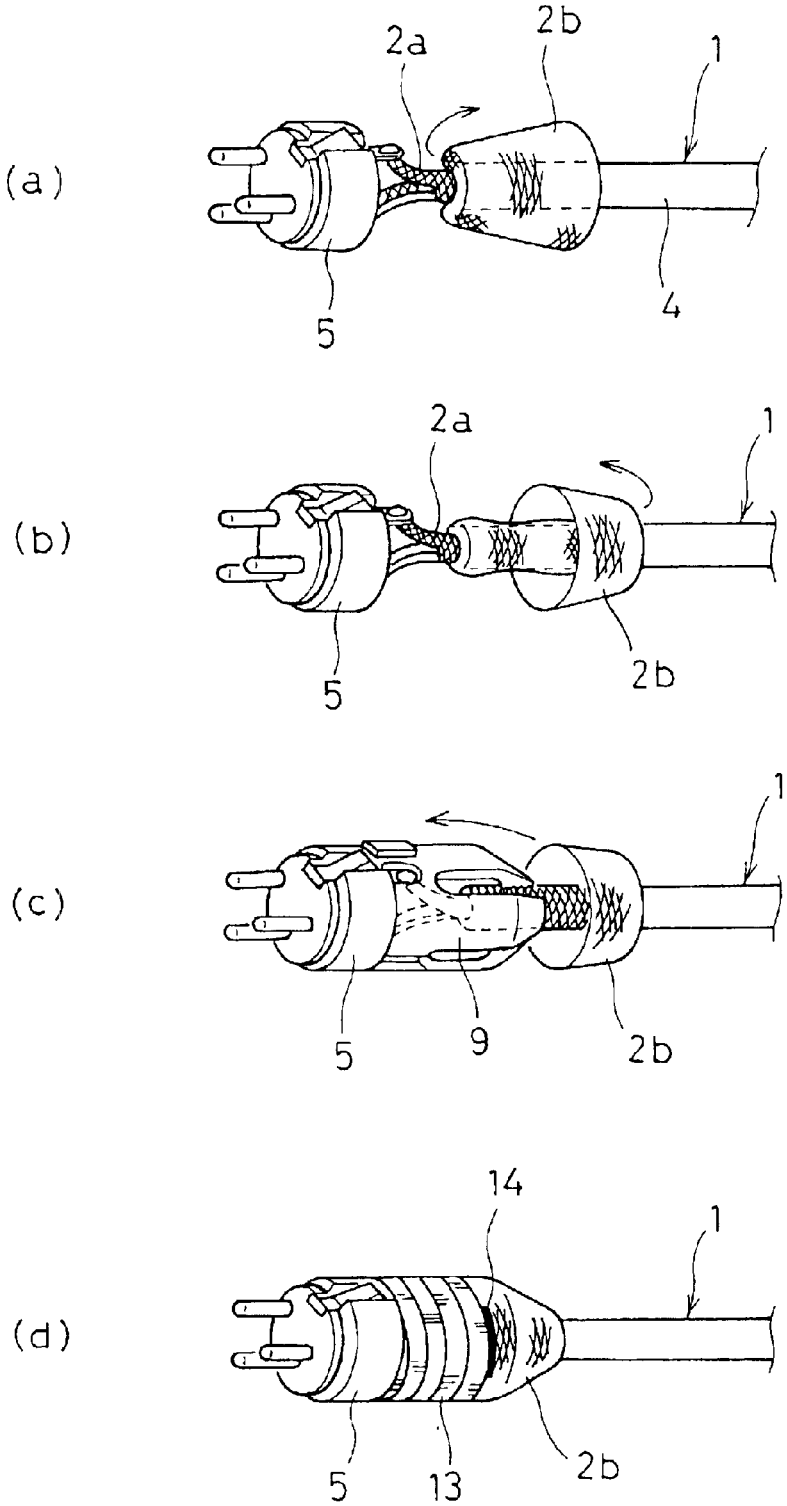
FIG. 4 is a perspective view showing an assembling process of Embodiment 2.

FIGS. 3 and 4 show Embodiment 2 of the present invention.

Embodiment 2 is different from Embodiment 1 only in that a cable having an outer conductor composed of a double braided wire is used as a cable 1.

To be specific, as shown in FIG. 4(*a*), the cable 1 is composed of an outer conductor 2*a* on the inside and an outer conductor 2*b* on the outside. The outer conductor 2*a* is soldered to a male contact 6*c* and a leaf spring terminal 6*d* of an insert 5, and the outer conductor 2*b* is folded to the rear so as to overlap an outer jacket 4.

And then, as shown in FIGS. 4(*b*) and 4(*c*), a chuck 9 is mounted on the rear of the insert 5, and the outer conductor 2*b* is folded on the outer peripheral surface of the chuck 9 as shown in FIG. 3. Besides, the folded outer conductor 2*b* is inserted into the housing 8 together with the insert 5 so as to be interposed between the outer peripheral surface of the chuck 9 and the inner peripheral surface of the housing 8, and a bushing 10 is screwed onto the housing 8, so that assembling is completed. Here, an interval is small between the housing 8 and the chuck 9. Thus, when the outer conductor 2*b* is disposed in the interval therebetween, the interposed outer conductor 2*b* is disposed between the outer peripheral surface of the chuck 9 and the inner peripheral surface of the housing 8 and the outer conductor 2*b* is pressed over the inner peripheral surface of the housing 8.

With this configuration, conduction is produced on the inner peripheral surface of the housing 8 via the outer conductor 2*b* so as to surround the insert 5. Hence, the rear of the insert 5 is shielded more surely than the prior art by the outer conductor 2*b* of the cable 1.

Here, as to a reduction in extraneous emission of high frequency harmonics nose, an important point is that the outer conductor 2 of the cable 1 is connected to the housing 8 not only at a contact point P1 with the leaf spring terminal 6*d* but also is brought into conduction on the inner peripheral surface of the housing 8 via the outer conductor 2*b*. Thus, it is possible to allow the housing 8 to be at the same potential as that of the outer conductor 2 in terms of high frequency waves, thereby remarkably improving extraneous emission of high frequency harmonics nose from the side of the housing 8 as compared with the prior art.

Further, in order to obtain workability when the insert 5 is inserted into the housing 8 and to further reduce extraneous emission, when the insert 5 is inserted into the housing 8, as shown in FIG. 4(*d*), a conductive tape 13 having an adhesive layer on one surface is wound around the outer conductor 2*b*, which is folded on the outer peripheral surface of the chuck 9, while a conducting surface is disposed outside. The conducting surface on an end of the wound conductive tape and the outer conductor 2*b* are brought into conduction via solder 14 and so on, and the insert 5 is inserted into the housing 8 in a state in which the outer conductor 2*b* is temporarily fixed so as not to be rolled up when the insert 5 is inserted into the housing 8.

In this case, the outer conductor 2 of the cable 1 is brought into conduction on the inner peripheral surface of the housing 8 via the outer conductor 2*b* and the conductive tape 13, thereby obtaining the same high frequency performance.

In the example of the conductive tape 13 of the above embodiment, the conducting surface of the conductive tape and the outer conductor 2*b* are in contact with each other via the adhesive layer of the conductive tape 13, so that conduction is not obtained. Hence, the conducting surface on the end of the wound conductive tape and the outer conductor 2*b* are brought into conduction via the solder 14 and so on. Here, when a conductive tape is used which has conductive particles mixed in an adhesive layer, it is possible to eliminate the necessity for the solder and further improve the high frequency performance.

Embodiment 3

Figure 5:
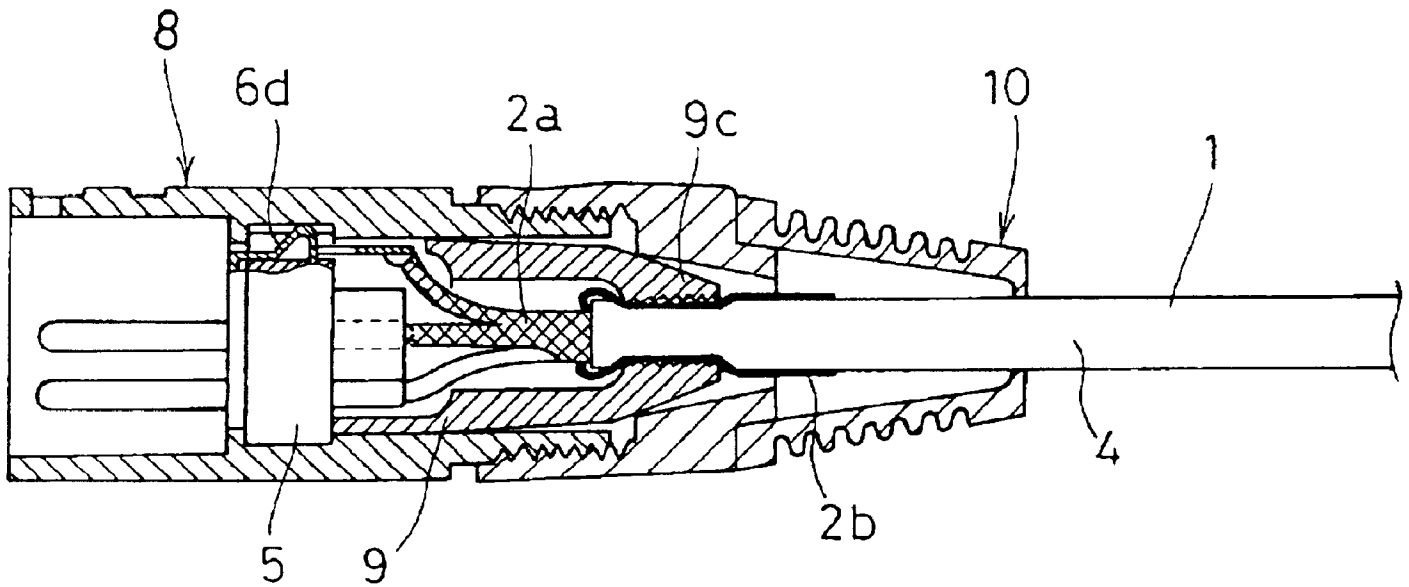
FIG. 5 is a sectional view showing a state of assembling a male XSR cable connector according to Embodiment 3 of the present invention.

FIG. 5 shows Embodiment 3 of the present invention.

Although the chuck 9 of Embodiment 2 is made of insulating resin as the prior art, a chuck 9 of Embodiment 3 is made of a conductive material, and an outer conductor 2*b* drawn from the inside to the outside of the chunk 9 is simply interposed between an outer jacket 4 of a cable 1 and a rear end portion 9*c* of the chuck 9 and is not folded on the outer periphery of the chuck 9.

Additionally, the chuck 9 is somewhat larger in diameter than that of Embodiment 2, and the chuck 9 is pressed over the inner periphery of the housing 8 in a state in which the chuck 9 is inserted into the housing 8 together with the insert 5. Further, a bushing 10 is mounted on the housing 8, so that the rear end portion 9*c* of the chuck 9 catches and holds an outer jacket 4 of the cable 1 via the outer conductor 2*b*. Thus, the chuck 9 made of a conductive material and the outer conductor 2*b* are more surely brought into conduction, and an outer conductor 2*a* of the cable 1 is brought into conduction on the inner periphery of the housing 8 via the outer conductor 2*b* and the chuck 9, thereby obtaining the same high frequency performance as Embodiment 2.

The chuck 9 is entirely made of a conductive material in Embodiment 3. The same high frequency performance as Embodiment 2 can also be obtained in the following configuration: the outer peripheral surface of Embodiment 2 that is made of insulating resin is formed, a conductive plated film is continuously formed from the inner surface of the rear end portion 9*c* to the outer peripheral surface of the chuck 9, and the outer conductor 2*a* of the cable 1 is brought into conduction on the inner periphery of the housing 8 via the outer conductor 2*b* and the conductive plated film formed on the chuck 9.

In the examples of Embodiment 3, the chuck 9 is somewhat larger in diameter than that of Embodiment 2, and the chuck 9 is pressed over the inner periphery of the housing 8 in a state in which the chuck 9 is inserted into the housing 8 together with the insert 5. The following configuration is also applicable: the chuck 9 is equal in diameter to that of Embodiment 2, the conductive tape used in Embodiment 2 is wound around the outer periphery of the chuck 9, and the outer periphery of the chuck 9 is pressed over the inner periphery of the housing 8 via the conductive tape. Moreover, in the case where the conductive tape is wound thus around the outer periphery of the chuck 9, as shown in FIG. 4(*d*), the same effect can be expected by winding the conductive tape around the outer conductor 2*b* folded on the chuck 9. Also, the same effect can be expected by winding the conductive tape around the chuck 9 instead of folding the outer conductor 2*b* on the chuck 9.

Besides, in Embodiment 3, a cable having an outer conductor composed of a double braided wire is used as the cable 1. Like Embodiment 1, the combination of the cable 1, which has an outer conductor composed of a single braided wire, and the braided wire 11 is also applicable.

Additionally, in the above described embodiments, a male XSR cable connector was described as an example, and the above description also holds for a female XSR cable connector.

As described above, according to the XSR cable connector of the present invention, the outer conductor of the cable or the conductor connected to the outer conductor extends from the inside to the outside of the chuck through the space between the outer jacket of the cable and the rear end portion of the chuck so as to be interposed between the outer peripheral surface of the chuck and the inner peripheral surface of the housing and so as to be in contact with the housing. Thus, the outer conductor of the cable is in contact with the inner peripheral surface of the housing 8 not at point but on a surface for conduction, allowing the housing to be at the same potential as that of the outer conductor in terms of high frequency waves, remarkably improving extraneous emission of high frequency harmonics nose from the side of the housing as compared with the prior art.

What is claimed is:

1. A cable connector, comprising:

a conductive housing;

a bushing;

an insert with an electrical contact on an outer periphery thereof, said insert located in the conductive housing and in electrical contact with an interior surface of the conductive housing;

a chuck having a leading end for insertion through a rear end portion of the housing and located in said housing so that said leading end abuts said insert, a first rear end portion of said chuck pressed into an inner periphery of the bushing, said bushing mounted on a rear end of said housing to receive a cable held by a second rear end portion of said chuck, wherein said chuck is for receiving an outer conductor of a cable, or a conductor connected to said outer conductor, which extends from an inside surface to an outside surface of said chuck through a space between an outer peripheral surface of a jacket of said cable and said second rear end portion of said chuck and interposed between an outer peripheral surface of said chuck and an inner peripheral surface of said housing, and said conductor is in electrical contact with said inner peripheral surface extending all around said housing.

2. The cable connector according to claim 1, further comprising a conductive tape, wherein said chuck is for receiving a conductor portion comprising an outer conductor of a cable or a conductor connected to said outer conductor, which extends from an inside surface to an outside surface of said chuck and is folded onto an outer periphery of said chuck, and said conductive tape is located around an outer peripheral surface of said conductor portion on the outer periphery of said chuck and in electrical contact with said inner peripheral surface of said conductive housing when said insert is located in the conductive housing and a cable is held by said second rear end portion of said chuck.

3. The cable connector according to claim 1, wherein said chuck is for receiving a cylindrical braided wire connected to an outer conductor of a cable.

4. The cable connector according to claim 1, wherein said chuck is for receiving a cable having an outer conductor comprising a double braided wire, wherein an outer braided wire of said outer conductor extends from the inside to the outside of said chuck and is folded on an outer periphery of said chuck.

5. A cable connector, comprising:

a conductive housing;

a bushing;

an insert with an electrical contact on an outer periphery thereof, said insert located in the conductive housing and in electrical contact with an interior surface of the housing;

a chuck having a leading end for insertion through a rear end portion of the housing and located in said housing so that said leading end abuts said insert, a first rear end portion of said chuck pressed into an inner periphery of the bushing, said bushing mounted on a rear end of said housing to receive a cable held by a second rear end portion of said chuck, wherein at least a part of said chuck is made of a conductive material for receiving an outer conductor of a cable, or a conductor connected to said outer conductor, interposed between an outer peripheral surface of a jacket of a cable and a the second rear end portion of said chuck for electrical connection with said chuck an extension of said outer conductor or the conductor connected to said outer conductor is in direct, and electrical contact with an inner peripheral surface extending all around said housing and an outer peripheral surface of said chuck.

6. A cable connector, comprising:

a conductive housing;

a bushing;

an insert with an electrical contact on an outer periphery thereof, said insert located in the conductive housing and in electrical contact with an interior surface of the conductive housing;

a chuck having a leading end for insertion through a rear end portion of the conductive housing and located in said housing so that said leading end abuts said insert, a first rear end of said chuck pressed into an inner periphery of the bushing, said bushing mounted on a rear end of said housing to receive a cable held by a second rear end portion of said chuck, wherein:

at least a part of said chuck is made of a conductive material for receiving an outer conductor of a cable, or a conductor connected to said outer conductor, interposed between an outer peripheral surface of a jacket of the cable and a second rear end portion of said chuck, for electrical connection with said chuck, and an extension of said outer conductor or the conductor connected to said outer conductor is in direct electrical contact with an inner peripheral surface extending all around said housing and an outer peripheral surface of said chuck, and said chuck and said inner peripheral surface of said conductive housing are for receiving an outer conductor of a cable having a conductive tape located therearound, for making electrical contact between the chuck, the outer conductor and an inner peripheral surface of said conductive housing.

* * * * *